United States Patent [19]

Axelsson

[11] 3,939,520

[45] Feb. 24, 1976

[54] TOOTH BRUSH

[76] Inventor: Per Axel Torbjörn Axelsson, Drottninggatan 27, 652 25 Karlstad, Sweden

[22] Filed: June 11, 1975

[21] Appl. No.: 585,871

[30] Foreign Application Priority Data

June 13, 1974 Sweden ..... 7407798

[52] U.S. Cl. ..... 15/167 R; 15/106; 15/160; 15/176; 132/93

[51] Int. Cl.[2] ..... A46B 9/04

[58] Field of Search ..... 15/106, 167 R, 110, 159, 15/160, 172, 176; 132/89, 93

[56] References Cited

UNITED STATES PATENTS

| | | | |
|---|---|---|---|
| 876,185 | 1/1908 | Hillman | 15/167 R |
| 1,465,522 | 8/1923 | Lunday | 15/167 R |
| 2,016,597 | 10/1935 | Drake | 15/110 X |
| 2,160,731 | 5/1939 | Haeberlin | 15/167 R |
| 3,559,226 | 2/1971 | Burns | 15/167 R |
| 3,672,378 | 6/1972 | Silverman | 132/93 |
| 3,720,975 | 3/1973 | Nelson | 15/167 R |
| D223,651 | 5/1972 | Hermann | D4/25 |

FOREIGN PATENTS OR APPLICATIONS

| | | | |
|---|---|---|---|
| 538,239 | 6/1922 | France | 15/167 R |
| 1,504,691 | 10/1967 | France | 15/167 R |

*Primary Examiner*—Peter Feldman
*Attorney, Agent, or Firm*—Cushman, Darby and Cushman

[57] ABSTRACT

A tooth brush is disclosed in which parallell bristles extend in opposite directions from a central plate-like stem connected to a shaft or a handle. The tooth brush is used for cleaning teeth interspaces and comprises a base plate which abuts the gum and protects the same when the bristles work upon opposite teeth faces. The bristles are longer next to the base plate and gradually shorter as the distance therefrom increases. Also in the length direction of the stem the length of the bristles varies, and the minimum bristle lengths are found either at the tip or at the middle of the length of the active part of the brush.

8 Claims, 5 Drawing Figures

TOOTH BRUSH

Deposits of bacteria upon the teeth (so-called plaque) are the cause of caries as well as teeth loosening diseases (parodontite). The deposits of bacteria are collected where they are best protected from the action of the chewing friction and the cleaning by the conventional tooth brush. It has also been established that the greatest loss of tooth attachment tissue takes place in the teeth interspaces. As a rule the severest caries damages are present upon tooth faces adjacent to the teeth interspaces.

In a vertical cross-sectional view the teeth interspace takes the general shape of an isosceles triangle, the base of which is considerably shorter than the sides thereof. In a horizontal cross-sectional view the teeth interspace is generally shaped as an hourglass on account of the round or oval cross-section of the teeth. Young persons with sound gums have the teeth interspace almost completely filled out by the gum papilla. These persons usually clean the tooth faces next to the interspace by means of a tooth thread or a triangular pointed tooth pick which in this case has a sufficient cleaning effect.

On the other hand, if gum inflammation proceeds into teeth loosening, the mandible and other attachments of the tooth start deteriorating towards the tip of the tooth root. The gum papilla disappears and the teeth interspace, triangular in the vertical cross-section, is laid bare. In these cases, a so-called interdental brush has been used hitherto as means for cleaning the teeth interspaces. Such a brush resembles a bottle-brush, i.e. it is of even width and circular cross-section. The round core consists of metal threads twisted together and grasping the brush bristles projecting in all directions. It is self-evident that such a round brush is unsuitable for efficient cleaning of the triangular teeth interspaces.

Based upon the above-mentioned circumstances and own research activities which have proved that a sufficiently frequent and efficient cleaning of all tooth faces prevents caries as well as tooth loosening, the present invention aims at creating a tooth brush by means of which it is possible to perform the above-mentioned cleaning of the teeth interspaces in an efficient and in all respects satisfying manner.

The object is attained by a particular design of tooth brush, the essential features of which consist in that it is provided with a straight stem approximately T-shaped in cross-section, which stem forms a base plate adapted for being pushed into a teeth interspace so as to rest upon and protect the gum, and also forms an attachment plate protruding at right angles from the longitudinal center line of the former, substantially parallel brush bristles extending therefrom in opposite directions and able of working simultaneously upon opposed faces of two adjacent teeth, the lengths of the bristles decreasing as the distance from the base plate increases. With said shape of the brush the tooth faces adjoining the teeth interspace are accessible for efficient cleaning while the risk of injuring the gum is eliminated. Characterising features of preferable constructive details of the tooth brush are set forth in the following claims.

The invention will now be described further, by way of example with reference to the accompanying drawings, in which FIG. 1 is a side view of a preferred embodiment of tooth brush;

Figure 1:
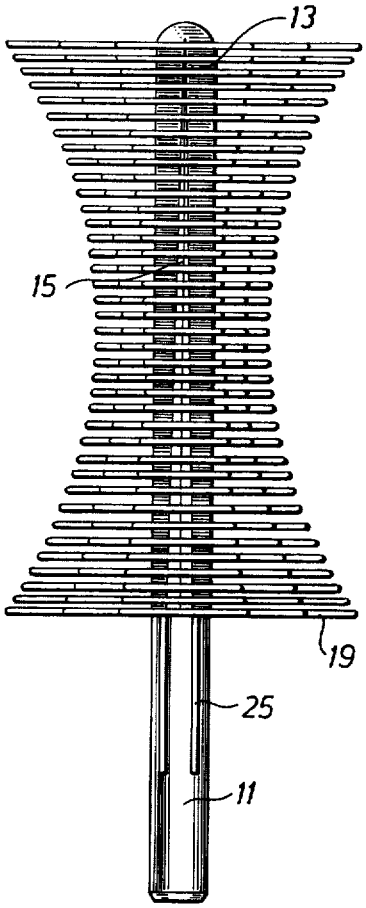
Figure 2:
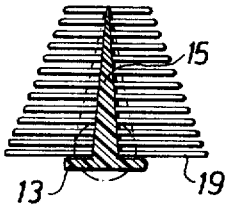
FIG. 2 is a cross-sectional view of FIG. 1.
Figure 4:
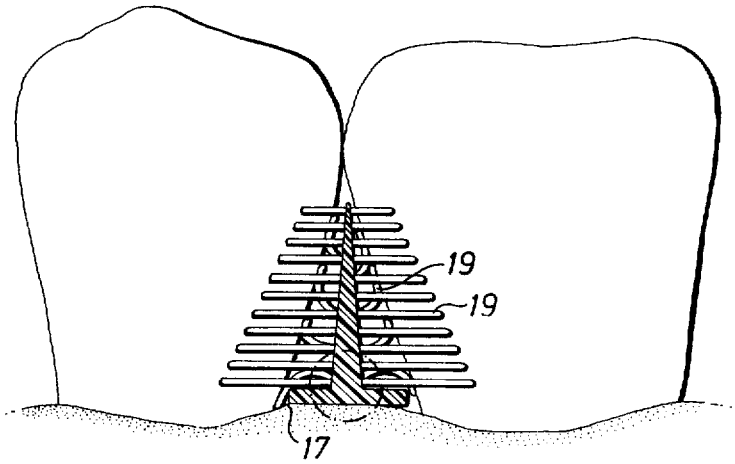
FIG. 4 is a cross-sectional view explaining the way of operation.
Figure 3:
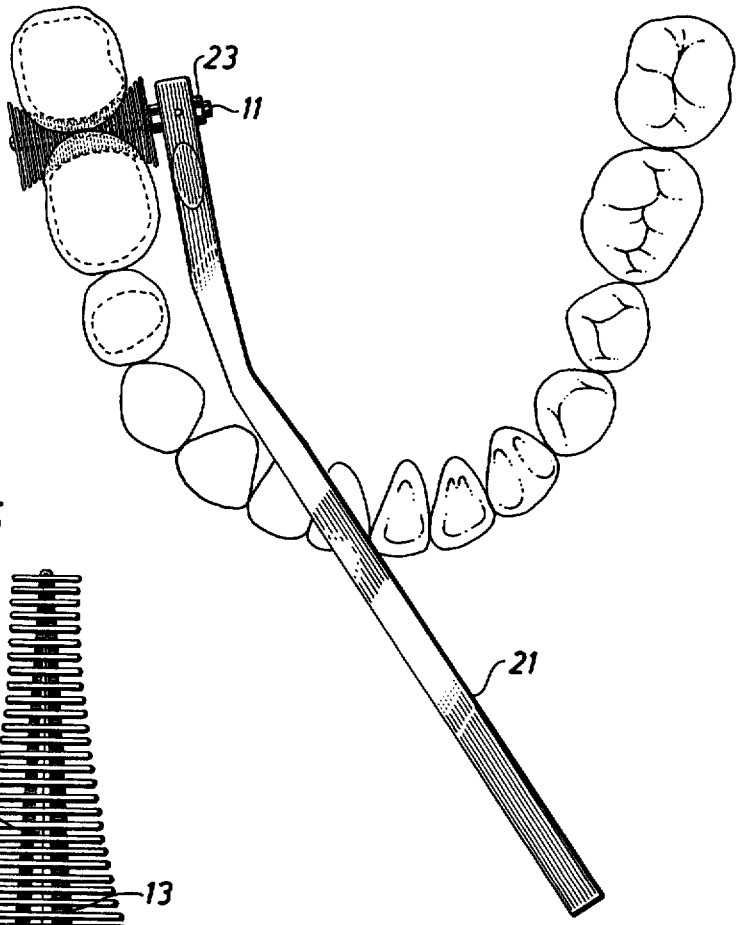
FIG. 3 shows the tooth brush, with pertaining handle, in use.

As shown particularly in FIGS. 1 and 2, the brush comprises a straight central stem forming the immediate extension of a shaft 11 and being approximately T-shaped in cross-section. Thus, it forms a base plate 13 of an approximately uniform width tapering towards its tip, and a plate 15 projecting from the longitudinal center line of the former and gradually thinned out. The plate 13 forms a supporting plate adapted during the use of the brush to abut the gum papilla 17 (FIG. 4), and the plate 15 is an attachment plate serving for retaining brush bristles 19. These are all substantially parallel to each other and to the width direction of the base plate and extend outwardly from both sides of the attachment plate, i.e. in two straight opposite directions. Preferably the bristles are arranged in parallel rows along the stem, but as an alternative they may be arranged in any oblique or irregular pattern. The bristles located next to the base plate 13 are the longest and extend beyond the edges thereof, and according as the bristles are situated farther from the base plate they are of shorter lengths. In the different cross-sections at right angles to the stem the profile of the brush takes the shape of an isosceles triangle with a cut top or an isosceles trapezium. The base plate is situated at the centre of the base of said geometrical figure, and the bristles end at the oblique sides of the triangle or trapezium. The cross-sections are congruent but of different sizes. Thus, at the middle of the length of the stem the bristles of all levels above the base plate 13 are shorter than at the ends of the stem. For instance, the bristle ends may be situated upon imaginary cylindrical surfaces turning their convex sides towards each other and having mutually inclined axes. With this configuration the exterior contour of the brush is adapted to the hour-glass shape of the teeth interspace. As is shown in FIGS. 3 and 4, when the brush has been pushed into an interdental space, the greater part thereof will be filled out, and contact is had between tooth faces and bristle ends over practically the entire extent of the tooth side from the gum to the tip, and this is true not only for the middle plane through the teeth row but also on the tongue as well as on the lip side thereof. When reciprocating the brush, the tooth faces are being worked upon, the bristles being slightly bent and therefore performing a more efficient cleaning action than if they would be bent down completely, as often is the case with the interdental brush of the bottle-brush type mentioned above. Another very important difference resides in that the bristles do not work upon the gum papilla, as when using a circular brush, where, when reversing the brush, the bristles are double-folded and exert a heavy pressure upon the gum involving the risk of hurting the same.

To the brush there belongs a handle 21 (FIG. 3), and inserted transversely through the end thereof and retained therein is a rotary sleeve 23. The brush shaft 11 is removably held by said sleeve with a friction grip which is reinforced by ribs 25 upon the cylindrical shaft. The brush thus being freely rotatable about its own axis, the same will automatically adjust itself into the proper position relatively to the tooth sides. As shown in FIG. 3, for certain back dental interspaces it may be best to insert the tooth brush from the inside of the teeth row.

Of course, it is also possible to hold the brush by grasping the shaft 11 directly by the fingers, the shaft then preferably being flattened and somewhat longer than shown.

Figure 5:
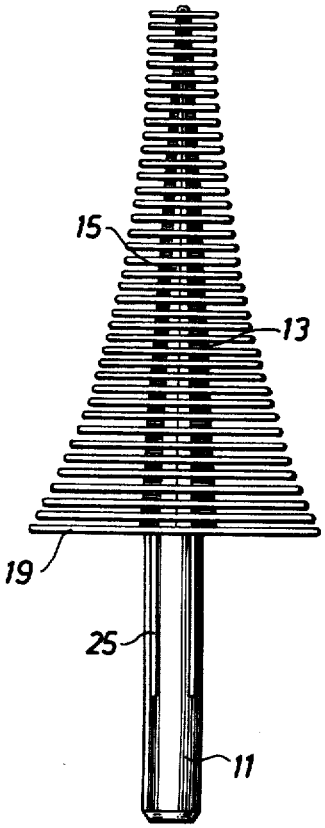
FIG. 5 shows a modified embodiment of tooth brush.

In the embodiment shown in FIG. 5, the cross-section of the brush tapers all the way to the tip of the brush. The advantage thereof is that it is possible to clean dental interspaces of considerably different sizes by inserting the brush a shorter or longer distance. The stem and the bristles are preferably manufactured as an integral piece of some suitable plastic material, such as nylon of polyethylene. If desired, the bristles may be made per se and be attached to the stem by moulding or melting. Suitable measurements are: length of the stem 15 to 20 mm, width of the base plate about 2 mm and height of the attachment plate 4 to 6 mm.

What I claim is:

1. A tooth brush for cleaning of teeth interspaces, comprising a straight stem of an approximately T-shaped cross-section forming a base plate adapted for insertion into a tooth interspace so as to rest upon and protect the gum, and also forming an attachment plate protruding at right angles to the longitudinal center line of the former, substantially parallel brush bristles extending outwardly therefrom in opposite directions and capable of working simultaneously upon opposed faces of two adjacent teeth, the lengths of the bristles decreasing as the distance from the base plate increases.

2. A tooth brush as claimed in claim 1, in which the different cross-sections of the brush are triangular or trapezium-shaped, the base plate being situated at the middle of the base of the triangle or trapezium and the tips of the bristles lying upon its oblique sides.

3. A tooth brush as claimed in claim 1, in which the bristles are arranged in rows parallel to the base plate.

4. A tooth brush as claimed in claim 1, in which the length of the bristles varies along the stem.

5. A tooth brush as claimed in claim 4, in which the bristles in each row are shorter at the middle of the stem than at its ends.

6. A tooth brush as claimed in claim 1, in which the stem is provided with a short substantially cylindrical shaft which is disengageably inserted into a sleeve extending transversely through and rotatably retained in the end of a handle pertaining to the brush.

7. A tooth brush comprising a straight stem having two opposed substantially planar faces, a set of parallel bristles extending from one of said faces, a second set of parallel bristles extending from the other side of said stem in a direction opposite to that of said first set of bristles, the lengths of the bristles varying in the length direction as well as in the transverse direction of said stem and the length of each bristle being the same as the length of a bristle located on the opposite side of the stem and substantially collinear thereto, the ends of the bristles in each cross-section of the stem coinciding with opposite inclined sides of an equilateral trapezium.

8. A tooth brush as claimed in claim 7, further comprising a base plate united with said stem and extending in the length direction over the main part of the length of the stem and in opposite transverse directions over part only of the length of the bristles next thereto.

* * * * *